United States Patent [19]

Henderson

[11] Patent Number: 4,753,390

[45] Date of Patent: Jun. 28, 1988

[54] CONTROLLED LIQUID ATOMIZER

[75] Inventor: Claudius L. Henderson, Evansville, Tenn.

[73] Assignee: Henderson and Sons, Inc., Dayton, Tenn.

[21] Appl. No.: 6,888

[22] Filed: Jan. 27, 1987

[51] Int. Cl.[4] ..... B05B 9/04

[52] U.S. Cl. ..... 239/8; 239/366; 239/373; 239/489

[58] Field of Search ..... 239/8, 365, 366, 368, 239/369, 373, 487, 489, 307, 304; 222/630

[56] References Cited

U.S. PATENT DOCUMENTS

| | | | |
|---|---|---|---|
| 1,875,729 | 9/1932 | Hermann | 239/366 |
| 1,954,173 | 4/1934 | Histed | 239/489 |
| 2,275,691 | 3/1942 | Simanton | 239/365 |
| 2,528,927 | 11/1950 | Vose | 239/366 |
| 2,609,233 | 9/1952 | Stearman | 239/366 |
| 3,322,350 | 5/1967 | Heinicke et al. | 239/307 |
| 4,397,422 | 8/1983 | Gwyn | 239/307 |

FOREIGN PATENT DOCUMENTS

| | | | |
|---|---|---|---|
| 408078 | 9/1923 | Fed. Rep. of Germany | 239/366 |
| 601257 | 2/1926 | France | 239/366 |

*Primary Examiner*—Andres Kashnikow
*Assistant Examiner*—Karen B. Merritt

[57] ABSTRACT

This invention relates to a method and apparatus for the conversion of a liquid into a mist and spray without the use of a compressor. The Atomizer can be adapted to accommodate several different liquids and can alternate from one to another, as desired.

3 Claims, 2 Drawing Sheets

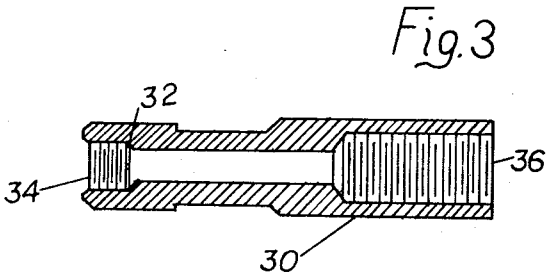
Fig. 3
Fig. 2
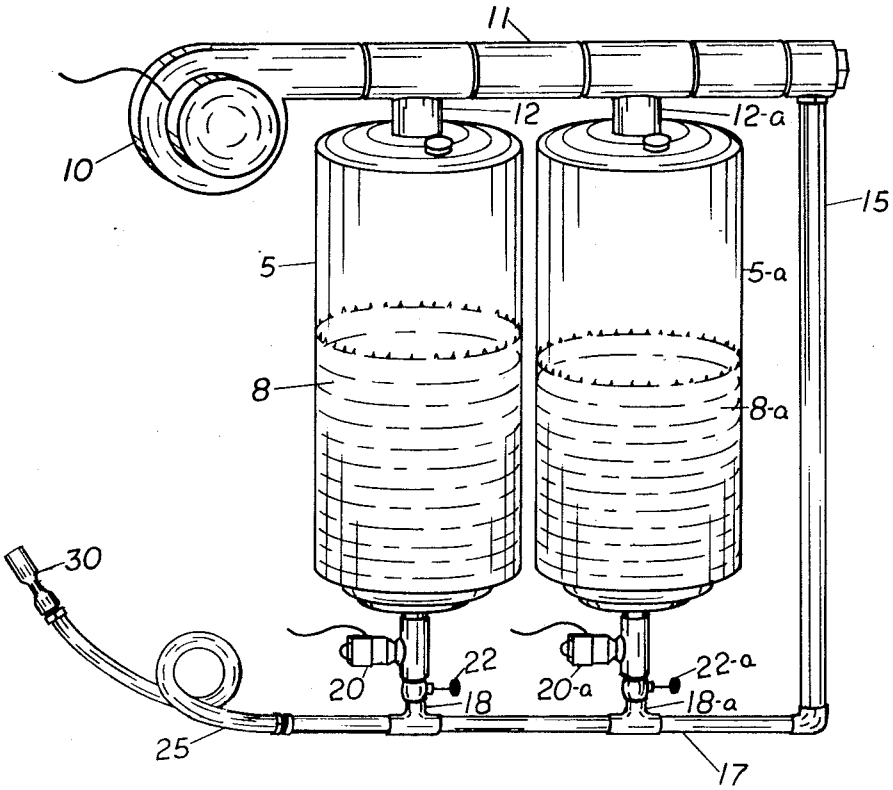

CONTROLLED LIQUID ATOMIZER

BACKGROUND OF THE INVENTION

There are various needs for mechanically converting selected liquids into a mist and spray. Such needs are usually met by the use of a mechanical device which contains a compressor and all the accessories such as pressure lines, pressure valves, gaskets and etc. that must accompany a pressurized system.

However, in this invention, the design relates to converting liquids into mist and spray without the use of a compressor and does not have the problems that accompany a compressor system.

SUMMARY OF THE INVENTION

The prurpose of this invention is to change liquids into mist and spray with the use of a near trouble free method. The design calls for an apparatus that only uses a fan to atomize its liquid, thus is relieved from the trouble that accompany a compressor pressurized system.

BRIEF DESCRIPTION OF DRAWINGS

Referring now to the drawings, said drawings show the apparatus and its functions that convert liquids into mist and spray:

FIG. 2 is a view of the apparatus showing that more than one container of liquids can be incorporated and selections of mist and spray can be extracted as desired.

FIG. 3 is a cut-a-way view of the dispenser nozzle.

DETAILED DESCRIPTION

Figure 1:
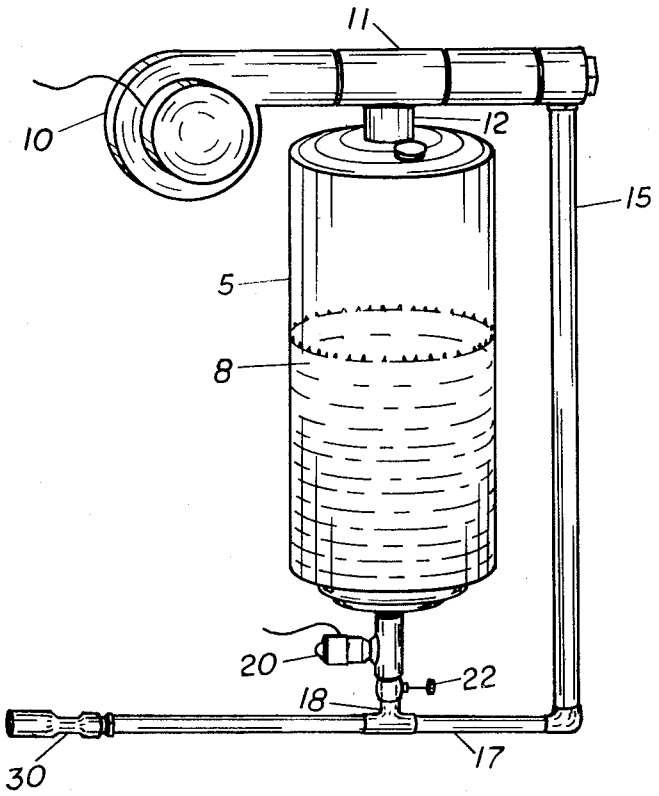
FIG. 1 is a view of the apparatus and its ocntainer of liquid, and the location of the fan and the dispenser nozzle.

Referring to FIG. 1, there is illustrated a layout of the apparatus. Container 5 holds a selected liquid 8. Fan 10 is positioned to deliver its output of air into air pipe 11 and air pipe 11 has its side connected to air pipe 12, which is connected to the upper portion of container 5, to allow air from fan 10 to pass freely through pipe 11 and into pipe 12 and into the upper portion of container 5 above its liquid contents. Air pipe 11 is also connected to air pipe 15, which is connected to air pipe 17 with air pipe 17 positioned near the lower part of container 5 and has its side connected to same through pipe 18, control valve 22, or a selected orifice, and solenoid valve 20. The end of air pipe 17 is attached to a dispenser nozzle 30, which contains a selected orifice and a series of inside threads inside its dispenser end.

Referring now to FIG. 2, there is illustrated the apparatus and how more than one container of liquid can be incorporated into said apparatus. Container 5 holds a selected liquid 8 and container **5-*a* holds another selected liquid 8-*a*. Fan 10 is positioned to deliver its output of air into air pipe 11. and air pipe 11 has its side connected to air pipe 12 and to air pipe 12-*a*, which are connected to the upper portion of containers 5 and 5-*a*, thus allowing air from fan 10 to pass freely through pipe 11 and into pipes 12 and 12-*a* and into the upper portions of container 5 and container 5-*a* above their liquid contents. Air pipe 11 is also connected to air pipe 15, which is connected to air pipe 17 with air pipe 17 positioned near the lower parts of containers 5 and 5-*a* and has its side connected to same through pipes 18 and 18-*a*, control valves 22 and 22-*a* and solenoid vlaves 20 and 20-*a*. The end of air pipe 17 is attached to flexible hose 25, which is attached to dispenser nozzle 30**, which contains a selected orifice and a series of inside threads inside its dispenser end.

Referring now to FIG. 3, there is illustrated a cut-a-way view of dispenser nozzle 30. Selected orifice 32 is shown positoned at the base of threads 34, which are used for attaching nozzle to apparatus. The series of threads 36 are shown at the dispensing end of said nozzle, which creates a swirling motion of the mist, as it dispenses from said nozzle into the atmosphere.

When fan 10 is on and operating, see FIG. 1, it delivers air into air pipe 11, with said air travelling through pipe 11 and having a portion pass through air pipe 12 and entering the top portion of container 5 above its liquid contents and increases the air pressure above said liquid. Said air continues to travel from said fan through air pipe 11 and passes into air pipe 15, travels through pipe 15 and passes into air pipe 17, travels through air pipe 17 and enters dispenser nozzle 30 and exits into the atmosphere. As said air travels through air pipe 17, solenoid valve 20 is opened at a selected time and allows liquid to pass from the bottom of container 5 through adjustable valve 22, which controlls the flow, and into air pipe 17 and into the stream of air that is passing through said pipe 17. The air stream picks up the liquid as it dispenses into it and carries it into dispenser nozzle 30, which dispenses it into the atmosphere in a fine mist. The orifice in dispenser nozzle 30 controls the volume of air and liquid mixture released by nozzle 30 and the inside series of threads create a swirling dispensing motion of the air and liquid mixture, thus dispensing said liquid in a fine mist.

It is to be understood that the foregoing drawings and description of the invention is to be taken as a preferred embodiment and that various other modifications will occur to those skilled in the art upon reading the disclosure, however all changes and modifications that come within the spirit of the invention are desired to be protected.

I claim:

1. An apparatus that converts liquids into mist and spray, comprising a. at least one container of liquid, b. an air blower unit positioned near the top of said container, or containers, with means of piping maximum portions of its output of air into the upper area of the container, or containers, c. means of piping selected portions of the air from the means of piping the maximum portions of the blower's output of air into the upper area of the container, or containers, to the base of said container, or containers, and then to a dispenser nozzle, said means consisting of a series of selected size air pipes, elbows, tees and connectors, d. means of delivering selected portions of liquid from the base of the container, or containers, into the means of piping selected portions of said air near the base of said container, or containers, and then to a dispenser nozzle, said means consisting of a series of selected valves, tubes and connectors, thus mixing the liquid and air by the use of gravity, suction and pressure, e. means of dispensing the air and liquid mixture through said dispenser nozzle to the atmosphere, as a mist and spray, said nozzle containing a selected pressure controlling orifice and a pressure reducing chamber having a series of inside spiral threads.

2. A method of converting liquids into mist and spray, comprising the steps of a. having at least one container of liquid, b. positioning an air blower unit near the top of said container, or containers, with means of piping maximum portions of its output of air into the upper area of the container, or containers, c. installing means of piping selected portions of the air from the means of piping the maximum portions of the blower's output of air into the upper area of the container, or containers, to the base of said container, or containers, and then to a dispenser nozzle, said means consisting of selected size air pipe, elbows, tees and connectors, d. installing means of delivering selected portions of liquid from the base of the container, or containers, into the means of piping selected portions of said air near the base of said container, or containers, and then to the dispenser nozzle, said means consisting of selected valves, tubes and connectors, thus mixing the liquid and air by the use of gravity, suction and pressure, e. installing means of dispensing the air and liquid mixture through said dispenser nozzle to the atmosphere, as a mist and spray, said nozzle containing a selected pressure controlling orifice and a pressure reducing chamber having a series of inside spiral threads.

3. A method of converting liquids into mist and spray, comprising the steps of a. having at least two containers of liquids, b. positioning an air blower unit near the top of said containers, with means of piping maximum portions of its output of air into the upper area of the containers, c. installing means of piping selected portions of the air from the means of piping maximum portions of the blower's output of air into the upper area of the containers, to the base of said containers and then to a dispenser nozzle, said means consisting of a series of selected size air pipes, elbows, tees and connectors, d. installing means of delivering selected portions of selected liquids from the base of the containers into the means of piping selected portions of said air near the base of said containers, and then to a dispenser nozzle, said means consisting of selected valves, tubes and connectors, thus mixing the liquids and air by the use of gravity, suction and pressure, e. installing means of dispensing the air and liquid mixture through said dispenser nozzle to the atmosphere, as a mist and spray, said nozzle containing a selected pressure controlling orifice and a pressure reducing chamber having a series of inside spiral threads.

* * * * *